US006785497B1

(12) United States Patent
Hasebe

(10) Patent No.: US 6,785,497 B1
(45) Date of Patent: Aug. 31, 2004

(54) TONER CARTRIDGE AND TONER SUPPLY DEVICE

(75) Inventor: Yoshifumi Hasebe, Shizuoka-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/394,213

(22) Filed: Mar. 24, 2003

(51) Int. Cl.[7] ..... G03G 15/08

(52) U.S. Cl. ..... 399/260; 399/258; 399/262; 222/DIG. 1

(58) Field of Search ..... 399/258, 260, 399/262, 263; 222/DIG. 1

(56) References Cited

U.S. PATENT DOCUMENTS 5,774,773 A * 6/1998 Otsuka et al. ..... 399/260
6,104,900 A * 8/2000 Ishikawa et al. ..... 399/262
6,334,037 B1 * 12/2001 Ise ..... 399/260
6,456,811 B1 * 9/2002 Kato ..... 399/262
6,671,482 B2 * 12/2003 DiIanni et al. ..... 399/262

FOREIGN PATENT DOCUMENTS

JP 8-095365 A 4/1996
JP 11-153904 * 6/1999 ..... G03G/15/08

* cited by examiner

*Primary Examiner*—Fred Braun
(74) *Attorney, Agent, or Firm*—Foley & Lardner LLP

(57) ABSTRACT

The toner cartridge of the present invention has a container for storing toner which is mounted and rotated on a cartridge holder, a toner feed port formed on the mount on the cartridge holder of the container, a shutter for opening and closing the toner feed port by rotating round the toner feed port, and a rotation mechanism for rotating the shutter by a linear operation for mounting and demounting the container from the cartridge holder, and furthermore, such a toner cartridge mounted feeds toner to the developing apparatus.

8 Claims, 4 Drawing Sheets

TONER CARTRIDGE AND TONER SUPPLY DEVICE

BACKGROUND OF THE INVENTION

1. Field of the Invention

The present invention relates to a toner cartridge and a toner feeder for feeding toner to a developing apparatus in an image forming apparatus such as a copying machine or a printer.

2. Description of the Related Art

In an image forming apparatus of an electro-photographic method such a copying machine, as a toner cartridge for feeding toner to a developing apparatus, a device that a feeding toner cartridge is mounted on the developing apparatus, and then the toner cartridge body is rotated, thus the switching member is rotated, and the outlet is opened is disclosed in Japanese Patent Application 8-95365. However, this conventional toner cartridge must be rotated after mounting on the developing apparatus, so that a space for rotating the toner cartridge is required in the image forming apparatus and miniaturization of the image forming apparatus body is disturbed.

On the other hand, in recent years, a device has been developed that using a shutter which slides in parallel with the toner cartridge mounting direction and opens or closes the toner feed port, the shutter slides and opens the toner feed port in correspondence with the sliding operation for mounting the toner cartridge on the developing apparatus and the shutter slides and closes the toner feed port in correspondence with the operation of pulling out the toner cartridge from the developing apparatus. When mounting or demounting the toner cartridge from the developing apparatus, there is no need to rotate the toner cartridge body, and the operation is easy, and the installation space can be reduced, and the image forming apparatus body is made more compact.

When the toner cartridge is to be mounted on the developing apparatus, the end of the shutter makes contact with the structure on the developing apparatus side and the shutter slides in the open direction. Thereafter, when the toner cartridge is to be pulled out from the developing apparatus, the shutter closes the toner feed port, so that the shutter is provided with an elastic hook which is partially deformed. Namely, when the toner cartridge is to be pulled out from the developing apparatus, the hook is restored by the elastic force to its original state that it is slightly projected from the shutter surface, and the hook is hooked on the projection formed on the developing apparatus side, thus the shutter is closed.

However, when the toner cartridge is mounted on the developing apparatus for many hours, the elastic force of the hook is deteriorated and there is the possibility that the hook is hardly restored to its original state. Therefore, when the toner cartridge is to be pulled out from the developing apparatus, the hook does not hook on the projection on the developing apparatus side, and the shutter is not closed, and the toner cartridge cannot be removed easily from the developing apparatus, and at the time of exchange of the toner cartridge, the peripheral part is soiled, and the operability may be lowered.

Therefore, a toner cartridge that the space is saved, and a shutter for surely opening and closing the toner feed port is provided, and excellent operability is realized is desired.

SUMMARY OF THE INVENTION

An object of the present invention is to surely open and close a toner feed port without performing an operation of rotation of the body of a toner cartridge by an operator after the toner cartridge is mounted on a developing apparatus, to make the body of an image forming apparatus more compact by space saving for toner cartridge installation, and to improve the operability of mounting and demounting of the developing apparatus.

According to the embodiment of the present invention, the toner cartridge comprises a container for storing toner which is mounted and rotated on a cartridge holder, a toner feed port formed on the mount on the cartridge holder of the container, a shutter for opening and closing the toner feed port by rotating round the toner feed port, and a rotation mechanism for rotating the shutter by a linear operation for mounting and demounting the container from the cartridge holder.

Furthermore, according to the embodiment of the present invention, the toner feeder comprises a cartridge holder for mounting in a removable state a toner cartridge having a cylindrical shutter for rotating round a toner feed port and opening and closing the toner feed port, and a rotation mechanism for inserting the toner cartridge into the cartridge holder by a linear operation, thereby rotating the shutter in the opening direction and pulling out the toner cartridge from the cartridge holder by the linear operation, thereby rotating the shutter in the closing direction.

DETAILED DESCRIPTION OF THE INVENTION

Figure 1:
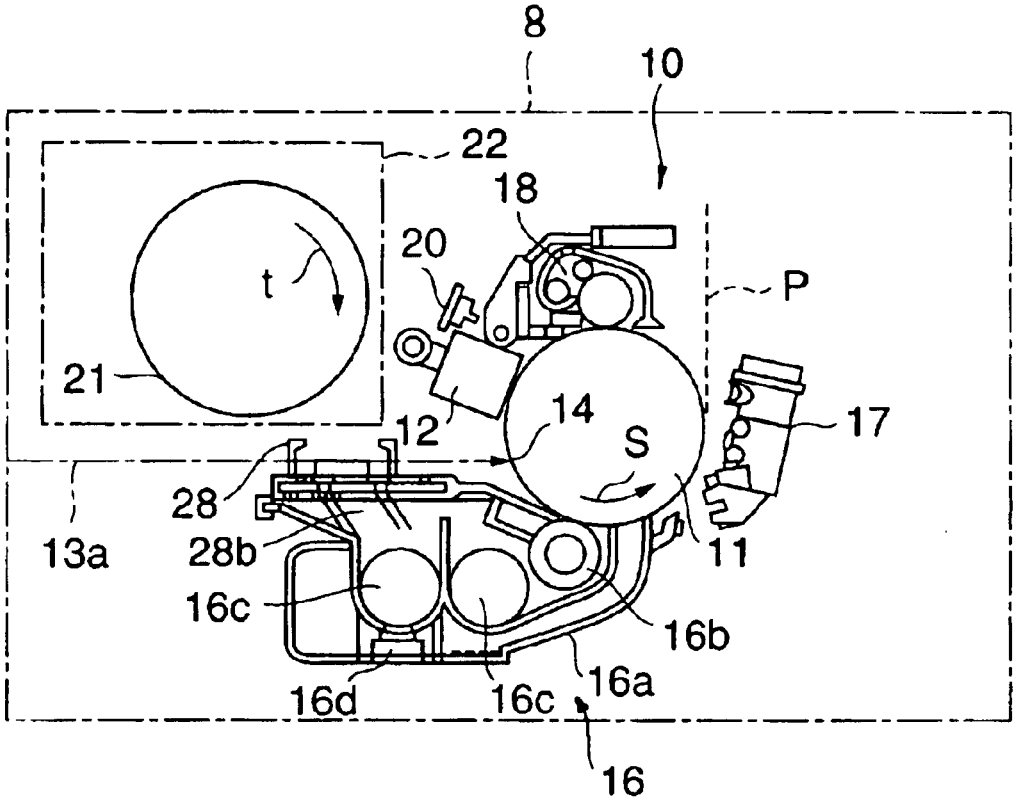
FIG. 1 is a block diagram schematically showing the image forming unit of the image forming apparatus of the embodiment of the present invention.

The embodiment of the present invention will be explained in detail hereunder with reference to the accompanying drawings. FIG. 1 is a schematic block diagram showing an image forming unit 10 of an image forming apparatus 8 which is an embodiment of the present invention. Around a photosensitive drum 11 of the image forming unit 10, a charger 12 for uniformly charging the photosensitive drum 11 sequentially according to the rotation of the photosensitive drum 11 in the direction of the arrow s, an irradiation position 14 of a laser beam 13*a* for forming a latent image on the charged photosensitive drum 11, a developing apparatus 16, a transfer-separation charger 17, a cleaner 18, and a static eliminator lamp 20 are arranged.

The developing apparatus 16 is a developing apparatus of a magnetic brush system, which is conventionally known, for developing using a 2-component developer made from toner and a carrier, and it has a developing roller 16*b* and a feed auger 16*c* in a developing container 16*a*. Further, the developing apparatus 16 has a toner concentration sensor 16*d*. Furthermore, the developing apparatus 16 has a toner feeder 22 for feeding toner fed from a toner cartridge 21 into the developing container 16*a* according to the toner concentration in the developer detected by the toner concentration sensor 16*d* at the end of the rear of an image forming apparatus 8.

Figure 2:
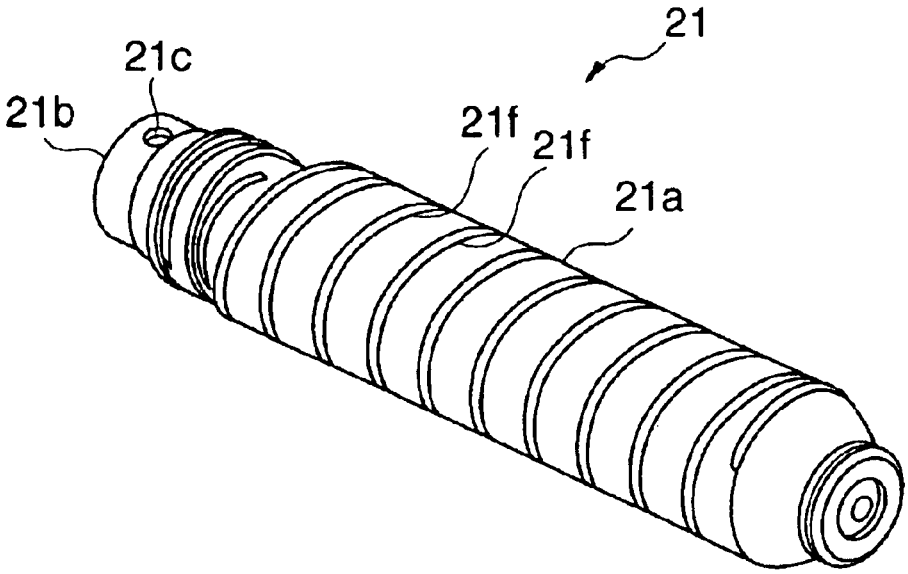
FIG. 2 is a perspective view showing the toner cartridge of the embodiment of the present invention.
Figure 3:
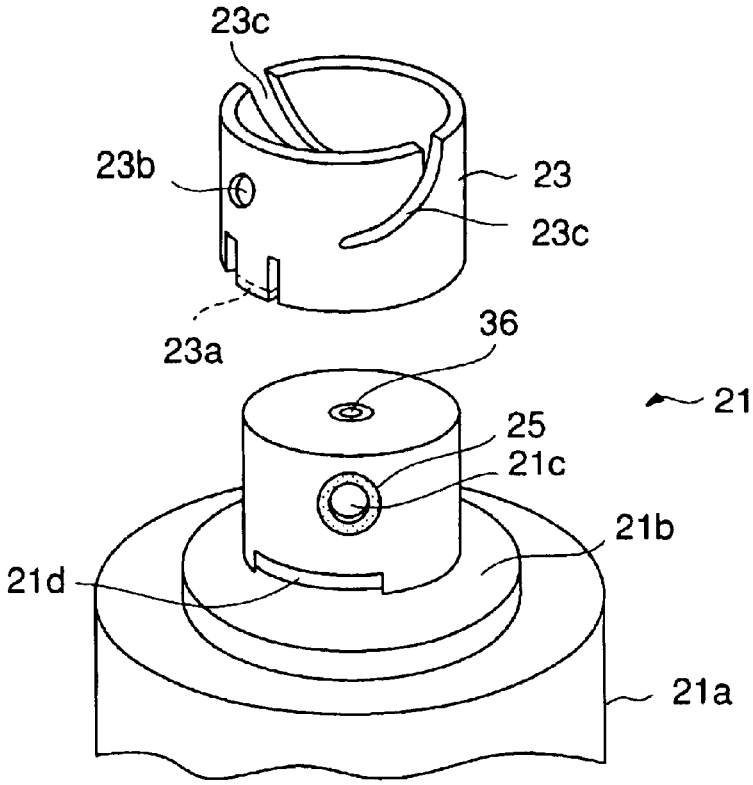
FIG. 3 is a schematic perspective view showing the cap part of the toner cartridge and the shutter of the embodiment of the present invention which are exploded.

In the cartridge 21, as shown in FIGS. 2 and 3, at the end of an almost cylindrical toner bottle 21*a* which is a container for storing toner and has a spiral feed slit 21*f* on the periphery thereof, a cylindrical cap part 21*b* made of POM (polyacetal) is mounted in a removable state. In the cap part 21*b*, a toner feed port 21*c* for feeding toner 27 for feeding in the toner bottle 21*a* to the toner feeder 22 is formed.

In the cap part 21*b*, a ring shutter 23 made of POM is fit. In a slit 21*d* formed in the cap part 21*b*, a convexity 23*a* formed in the inner wall of the shutter 23 is fit and the cap part 21*b* and the shutter 23 rotate relatively. In the shutter 23, an opening 23*b* for opening the toner feed port 21*c* and slits 23*c* which are a rotation mechanism for rotating the shutter 23 and a spiral guide are formed. The toner feed port 21*c* of the cap part 21*b* is surrounded by an elastic seal agent such as urethane so as to prevent the toner 27 from leaking through the gap between the toner feed port 21*c* and the shutter 23.

Figure 4:
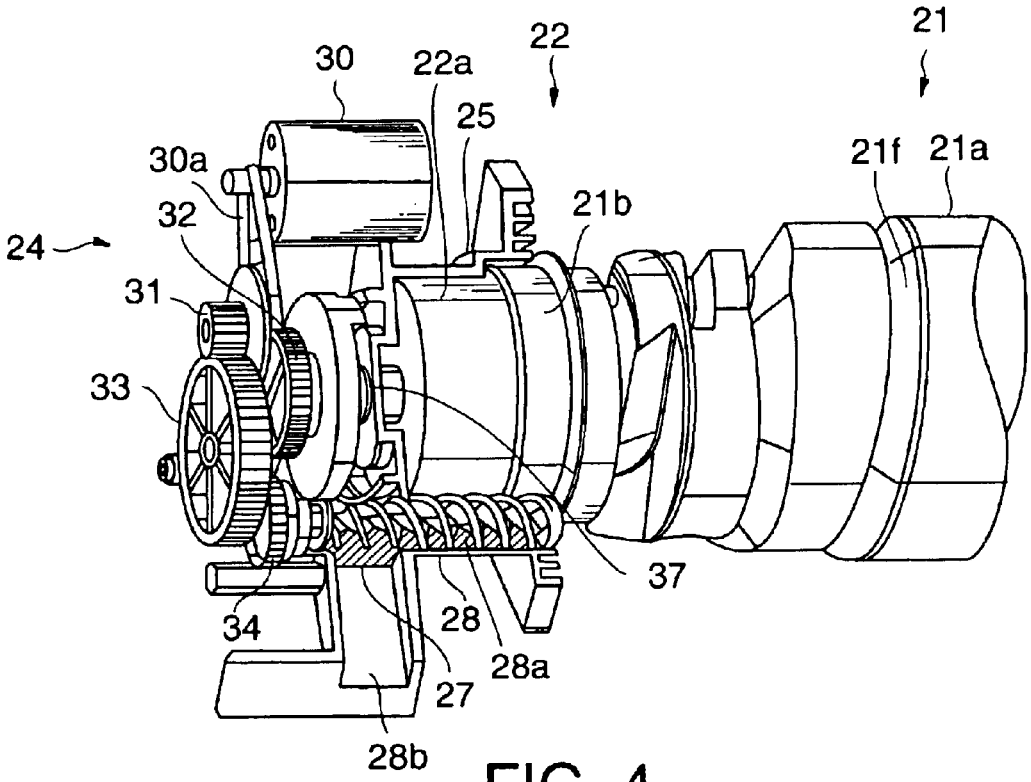
FIG. 4 is a schematic perspective view showing the toner feeder of the embodiment of the present invention.
Figure 5:
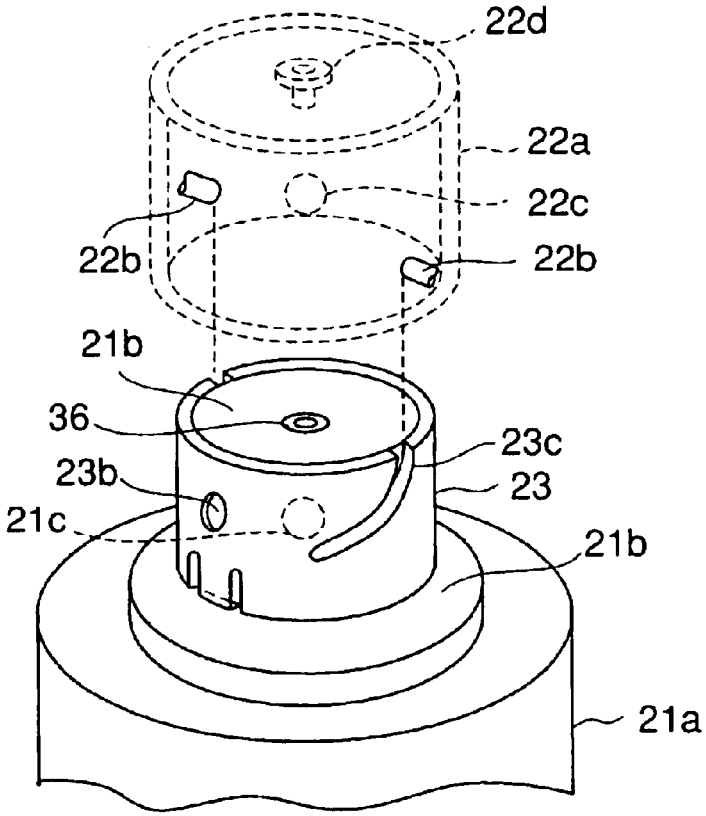
FIG. 5 is a schematic illustration showing an arrangement of the toner cartridge of the embodiment of the present invention and a holder guide before mounting on the holder guide.

As shown in FIGS. 4 and 5, the toner feeder 22 has a cover part 26. The cover part 25 supports a cylindrical holder guide 22*a* in a rotatable state which is a cartridge holder for mounting and demounting the toner cartridge 21 in an exchangeable state. In the holder guide 22*a*, a toner outlet 22*c* is formed and in a state that the toner cartridge 21 is mounted on the holder guide 22*a*, the toner feed port 21*c* of the cap part 21*b*, the opening 23*b* of the shutter 23, and the toner outlet 22*c* of the holder guide 22*a* coincide with each other in position. On both sides of the inner wall of the holder guide 22*a*, projections 22*b* fit in the slits 23*c* of the shutter 23 are formed.

The toner feeder 22 has a drive unit 24 for driving and rotating both the holder guide 22*a* and the toner cartridge 21 mounted on the holder guide 22*a* in the cover part 25. The toner feeder 22 has a toner buffer 28 which is a toner feed mechanism for feeding the toner 27 fed from the toner cartridge 21 via a cover opening (not shown in the drawing) formed in the cover part 25 into the developing container 16*a*. The drive unit 24 drives a toner feed auger 28*a* in the toner buffer 28.

The drive unit 24 transfers the driving from a driving motor 30 to a holder guide gear 32 via a belt 30*a* and a first speed change gear 31. Further, the drive unit 24 transfers the driving from the driving motor 30 to a toner feed auger gear 34 via the belt 30*a*, the first speed change gear 31, and a second speed change gear 33. The holder guide gear 32 drives a driving shaft 37 axially connected to the holder guide 22*a*. The cap part 21*b* has a joint 36 fit in a bearing 22*d* formed on the holder guide 22*a*. The toner cartridge 21 attached to the holder guide 22*a*, while it rotates together with the holder guide 22*a* by driving of the driving shaft 37 due to driving of the driving motor 30, feeds the toner 27 to the toner buffer 28 from the toner feed port 21*c*. On the toner buffer 28, a toner feed port 28*b* connected to the developing container 16*a* is installed.

Figure 6:
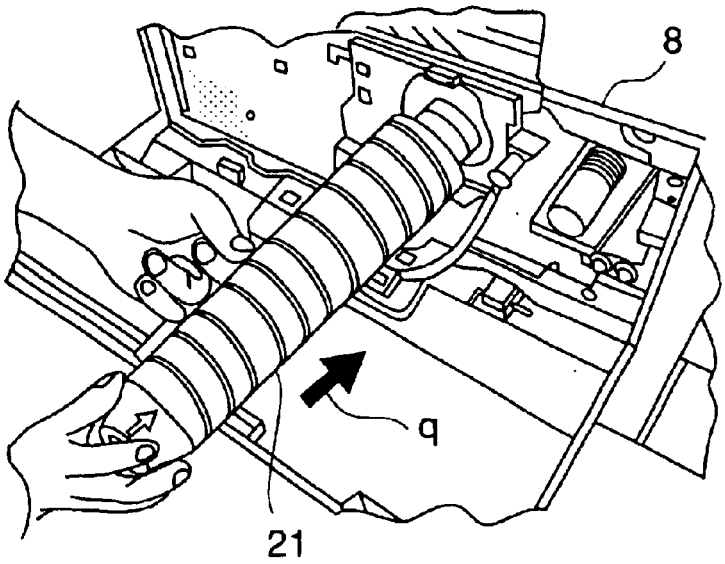
FIG. 6 is a schematic perspective view showing mounting of the toner cartridge of the embodiment of the present invention on the image forming apparatus.

Next, the process of mounting the toner cartridge to the holder guide 22*a* will be described. The shutter 23 of a new toner cartridge 21 before mounting to the holder guide 22*a* is fit in the cap part 21*b* in a state that the position of the opening 23*b* is shifted from the toner feed port 21*c* in an about 90° arc. The new toner cartridge, as shown in FIG. 6, slides in the direction of the arrow q toward the rear side from the front side of the image forming apparatus 8.

When the cap part 21*b* of the toner cartridge 21 reaches the holder guide 22*a* on the rear side of the image forming apparatus 8, the slits 23*c* of the shutter 23 are fit to the positions of the projections 22*b* formed on the inner wall of the holder guide 22*a*. At this time, the toner feed port 21*c* is arranged so as to be opposite to the toner outlet 22*c* of the holder guide 22*a*.

Figure 7A:
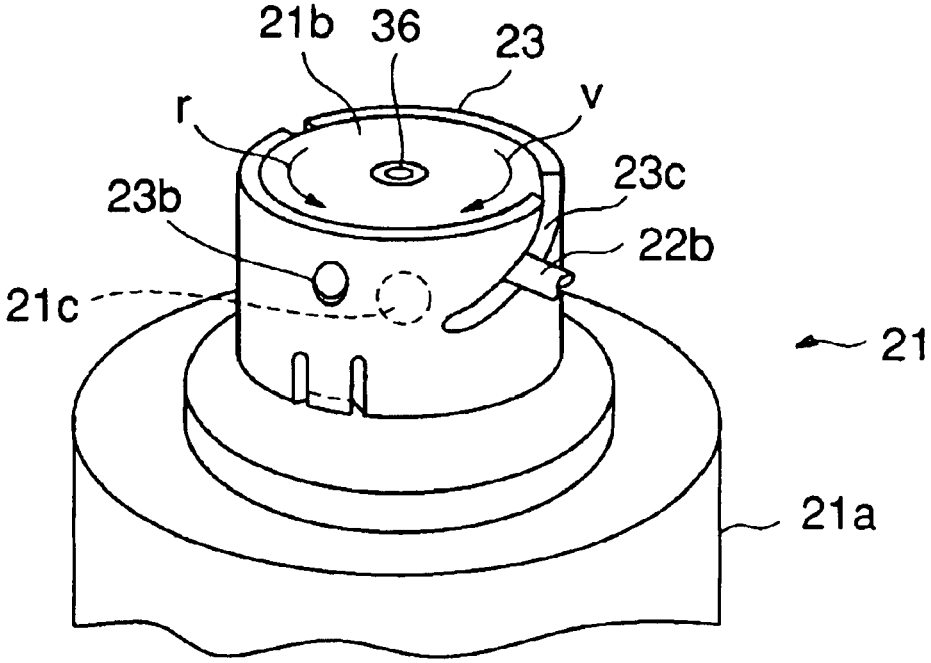
FIG. 7A is a schematic illustration showing an arrangement of the toner cartridge of the embodiment of the present invention and the holder guide during mounting on the holder guide.

Furthermore, the toner cartridge 21 slides in the direction of the arrow q, and the cap part 21*b* is inserted into the holder guide 22*a*, and the toner cartridge 21 is mounted on the holder guide 22*a*. At this time, the fixed projections 22*b* are fit into the slits 23*c* of the shutter 23, and the slits 23*c* and the projections 22*b* slide relatively, so that the shutter 23 is guided by the slits 23*c* and as shown in FIG. 7*a*, according to sliding of the toner cartridge 21 in the direction of the arrow q, the shutter 23 is rotated in the opening direction of the toner feed port 21*c* which is the direction of the arrow r.

Figure 7B:
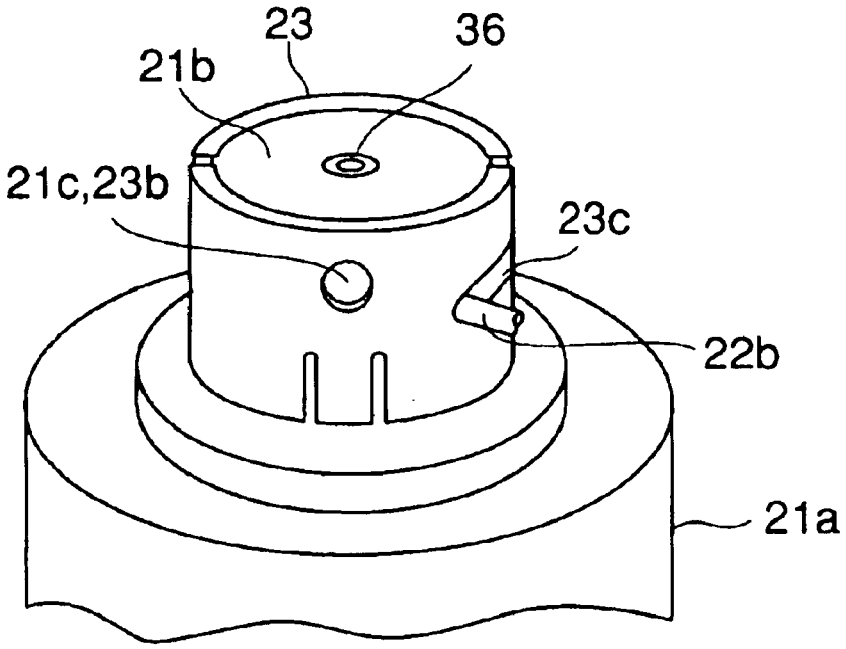
FIG. 7B is a schematic illustration showing an arrangement of the toner cartridge of the embodiment of the present invention and the holder guide at the end of mounting on the holder guide.

As shown in FIG. 7B, when the projections 22*b* are inserted up to the ends of the slits 23*c* and the cap part is mounted on the holder guide 22*a*, the shutter 23 rotates in an almost 90° arc in the direction of the arrow r, and the position of the opening 23*b* coincides with the position of the toner feed port 21*c*, and the toner feed port 21*c* is released from the closing state by the shutter 23 and opened. Therefore, the toner cartridge 21 is mounted on the holder guide 22*a* in a state that the toner 27 can be fed to the toner outlet 22*c* from the toner feed port 21*c*. Further, when the cap part is mounted on the holder guide 22*a*, the joint 36 of the cap part 21*b* is fit into the bearing 22*d* of the holder guide 22*a*.

When the image forming process is started next, the photosensitive drum 11 is uniformly charged by the charger 12 according to the rotation in the direction of the arrow s and irradiated with the laser beam 13*a* according to an image signal. By doing this, an electrostatic latent image is formed on the photosensitive drum 11 and when the photosensitive drum 11 reaches the developing apparatus 16, a toner image is formed. Then, the toner image on the photosensitive drum 11 is transferred onto a recording paper P by the transfer-separation charger 17. After end of transfer, the photosensitive drum 11 passes through the cleaner 18 and the static eliminator lamp 20 and enters the next image forming state. Further, the recording paper P separated from the photosensitive drum 11 after transfer of the toner image is fixed by a fixing apparatus not shown in the drawing and the image forming process is finished.

While such an image forming process is performed, when a reduction in the toner concentration in the developing container 16*a* is detected by the toner concentration sensor 16*d*, the driving motor 30 is driven and by the driving shaft 37 attached to the holder guide gear 32 via the first speed change gear 31, the holder guide 22*a* and the toner cartridge 21 are integrally rotated in a predetermined amount in the direction of the arrow t. At this time, the shutter 23 is controlled and stopped by the projections 22*b*. By rotation of the toner cartridge 21, the toner 27 in the toner bottle 21*a* is fed sequentially in the direction of the toner feed port 21*c* along the feed slit 21*f* and at the position where the holder guide 22*a* and the toner cartridge 21 make one revolution and the toner outlet 22*c* of the holder guide 22*a* and the opening of the cover part 25 coincide with each other, it is fed to the toner buffer 28.

Further, at the same time, by driving of the driving motor 30, the toner feed auger gear 34 is rotated via the first speed change gear 31 and the second speed change gear 33 and the toner feed auger 28*a* is rotated in a predetermined amount. By rotation of the toner feed auger 28*a*, the toner 27 in the toner buffer 28 is sequentially fed in the direction of the toner feed port 28*b* and fed into the developing container 16*a* in a predetermined amount. By feeding of the toner 27, when the toner concentration sensor 16*d* detects that the toner concentration in the developing container 16*a* reaches a necessary toner concentration, the driving motor 30 is stopped and the toner feed operation is finished.

When the toner feed operation is performed as mentioned above and the tone 27 in the toner bottle 21*a* is all gone, the empty toner cartridge 21 is made slide on the front side of the image forming apparatus 8 in the opposite direction of the direction of the arrow q, pulled out from the image forming apparatus 8, and exchanged with a new toner cartridge 21. When the toner cartridge 21 is pulled out and the cap part 21*b* is to be removed from the holder guide 22*a*, the shutter 23 is guided by the slits 23*c* controlled by the projections 22*b* and rotates in the closing direction of the toner feed port 21*c* in the direction of the arrow v which is the opposite direction of the direction of the arrow r.

By the rotation of the shutter 23 in the direction of the arrow v, the opening 23*b* moves from the position of the toner feed port 21*c*. When the cap part 21*b* is completely pulled out from the holder guide 22*a*, the shutter 23 returns to the state before the toner cartridge 21 is mounted that the position of the opening 23*b* is shifted from the position of the toner feed port 21*c* in an about 90° arc and closes the toner feed port 21*c*. Therefore, the toner is prevented from dropping from the toner feed port 21*c* and the empty toner cartridge 21 can be taken out from the image forming apparatus 8. Thereafter, a new toner cartridge 21 is made slide from the front side of the image forming apparatus 8 in the direction of the arrow q and mounted on the holder guide 22*a* and the exchange of the toner cartridge 21 is finished.

According to this embodiment, at the time of exchange of the toner cartridge 21 which is mounted on the toner feeder 22 in an exchangeable state, only by sliding and moving the toner cartridge 21 from the front side of the image forming apparatus 8 toward the rear side and inserting it into the holder guide 22*a*, the shutter 23 can be rotated and moved, and when the toner cartridge 21 is mounted on the holder guide 22*a*, the toner feed port 21*c* can be opened. On the other hand, when the toner cartridge 21 is to be taken out from the holder guide 22*a*, only by sliding and moving the toner cartridge 21 in the direction of the front side of the image forming apparatus 8 and then pulling out it, the shutter 23 can surely close the toner feed port 21*c*. Therefore, although the operation at the time of exchange of the toner cartridge 21 is simple, there is no possibility that the shutter 23 is not closed, thus the periphery is soiled and the operability and reliability of exchange of the toner cartridge 21 can be improved. Moreover, the shutter 23 of the toner cartridge 21 can surely rotate only by forming the slits 23*c* as a rotation mechanism, and the toner feed port 21*c* can be surely opened and closed, and no complicated rotation mechanism is required, thus the cost of the toner cartridge 21 can be reduced.

Further, at the time of exchange and maintenance of the toner cartridge 21, only by just sliding and moving the toner cartridge, an operator can easily exchange the toner cartridge 21 and after the toner cartridge 21 is mounted on the holder guide 22*a*, no additional operation is required. Therefore, space reduction necessary to exchange the toner cartridge 21 can be realized and the image forming apparatus 8 can be made more compact.

Further, the present invention is not limited to the aforementioned embodiment and can be changed variously within the range of the present invention. For example, although the materials of the cap part and shutter are optional, it is preferable to use materials of a lower friction factor to relatively rotate the cap part and shutter. Further, the forming position of the shutter opening is neither limited and if it is a position where the toner feed port is opened when the toner cartridge is mounted on the developing apparatus and the toner feed port is closed when the toner cartridge is removed from the developing apparatus, the position is acceptable.

Furthermore, the toner cartridge may be a one that a toner feeding auger is provided in the bottle, and during feeding of toner, the bottle does not rotate, and the internal auger rotates and feeds toner toward the toner feed port. Further, the cap part of the toner cartridge may not be removable, though if it is removable, toner can be easily fed and recycled. Further, the spiral guide formed on the shutter may be a concave slit whose surface is ground instead of an opened slit and moreover, it is also acceptable that the shutter is formed as a rotation mechanism, and a projection member is formed on the shutter side, and a spiral guide is formed on the cartridge holder side.

As described above in detail, according to the present invention, at the time of exchange of the toner cartridge, only by inserting and mounting the toner cartridge in the developing apparatus and pulling out and removing it from the developing apparatus, the shutter can be surely rotated and the toner feed port can be surely opened or closed. Therefore, the toner cartridge can be mounted or demounted very easily, and there is no possibility that at the time of removing the toner cartridge, the shutter is not closed, thus the periphery is soiled, and the operability and reliability at the time of exchange of the toner cartridge 21 can be improved. At the same time, the image forming apparatus body can be made compact due to reduction in the installation space of the toner cartridge. Furthermore, no complicated mechanism for opening and closing the shutter is required and the cost of the toner cartridge can be reduced.

What is claimed is:

1. A toner cartridge comprising:

a container to store toner, which is mounted and rotated on a cartridge holder;

a toner feed port formed on a mount on said cartridge holder of said container;

a shutter to open and close said toner feed port by rotating round said toner feed port; and a rotation mechanism to rotate said shutter by a linear operation to mount and demount said container from said cartridge holder.

2. The toner cartridge according to claim 1, wherein said mount is cylindrical, and said shutter is a cylindrical shutter having an opening conducting to said toner feed port and surrounding an outer periphery of said mount, and said rotation mechanism is composed of a spiral guide or a projection member fit into said spiral guide, and either one of said spiral guide and said projection member is formed on said cylindrical shutter, and by mounting or demounting said container from said cartridge holder on which the other one of said spiral guide and said projection member is formed, said spiral guide and said projection member relatively slide and said cylindrical shutter rotates.

3. The toner cartridge according to claim 2, wherein said spiral guide is formed on said cylindrical shutter.

4. The toner cartridge according to claim 3, wherein said spiral guide is a spiral slit formed in said cylindrical shutter.

5. A toner feeder comprising:

a cartridge holder to mount in a removable state a toner cartridge having a cylindrical shutter to rotate round a toner feed port and open and close said toner feed port; and a rotation mechanism to insert said toner cartridge into said cartridge holder by a linear operation, thereby rotating said shutter in the opening direction and pulling out said toner cartridge from said cartridge holder by said linear operation, thereby rotating said shutter in the closing direction.

6. The toner feeder according to claim 5, wherein said rotation mechanism is composed of a spiral guide or a projection member fit into said spiral guide, and either one of said spiral guide and said projection member is formed on said cartridge holder, and said toner cartridge having said cylindrical shutter on which the other one of said spiral guide and said projection member is formed is inserted into said cartridge holder by a linear operation or said toner cartridge is pulled out from said cartridge holder by the linear operation, thus said spiral guide and said projection member relatively slide and said cylindrical shutter rotates.

7. The toner feeder according to claim 6, wherein said cartridge holder mounts said toner cartridge having said projection member and said cylindrical shutter on which said spiral guide is formed.

8. The toner feeder according to claim 7, wherein said spiral guide is a spiral slit formed in said cylindrical shutter.

* * * * *